United States Patent [19]

Saito

[11] Patent Number: 4,914,820

[45] Date of Patent: Apr. 10, 1990

[54] STRUCTURE FOR ROTATION CENTER OF SCISSORS

[75] Inventor: Tatsuya Saito, Seki, Japan

[73] Assignee: Kai R&D Center Co., Ltd., Seki, Japan

[21] Appl. No.: 293,926

[22] Filed: Jan. 5, 1989

[30] Foreign Application Priority Data

Jul. 22, 1988 [JP] Japan ..... 63-184414

[51] Int. Cl.[4] ..... B26B 13/00

[52] U.S. Cl. ..... 30/254; 30/239

[58] Field of Search ..... 30/254, 239, 237, 341, 30/252

[56] References Cited

U.S. PATENT DOCUMENTS 4,761,883 8/1988 Mertens ..... 30/254

FOREIGN PATENT DOCUMENTS 62-115873 7/1987 Japan .

63-18975 2/1988 Japan .

63-25961 2/1988 Japan .

*Primary Examiner*—Frank T. Yost

*Assistant Examiner*—Willmon Fridie, Jr.

*Attorney, Agent, or Firm*—Stephen G. Rudisill

[57] ABSTRACT

A pair of scissor segments are connected at a rotation center to be mutually openable and closable. In the one scissor segment, a projection has a stem portion integrally formed on the inner surface of the rotation center. In the other scissor segment, a concave portion is formed in the inner surface of the rotation center. The concave portion are provided with an opening allowing the projection to enter thereinto, and a stem supporting portion rotatably supporting the stem portion of the projection entered into the opening. When both the scissor segments are connected with each other, the projection is not exposed from the outside surfaces of the scissor segments.

7 Claims, 6 Drawing Sheets

STRUCTURE FOR ROTATION CENTER OF SCISSORS

BACKGROUND OF THE INVENTION

1. Field of the Invention

This invention relates to a structure for rotation center of scissors.

2. Related Art

In scissors, a pair of scissor segments, in a state one placed upon another at their rotation centers, are jointed by a center shaft to be openable and closable. However, the above described scissors have both ends of the center shaft exposed from both segment surfaces to deterionate the appearance.

For the purpose of solving the problem, for example, in scissors described in Japanese Laid Open Utility Model Publication No. 62-115873 (laid open on July 23, 1987), concave portions are provided on surfaces of both scissor segments around a center shaft and both ends of the center shaft are covered with caps respectively fitted to each concave portion. However, these scissors need more parts and more manufacturing steps, thereby making the assemblage troublesome and causing another problem such as higher manufacturing costs.

SUMMARY OF THE INVENTION

The present invention is for solving the above described problems. It is an object of the present invention to provide a structure for rotation center in scissors which needs fewer parts so as to make assemblage quite easy, which avoids exposure of a pivot from each scissor segment surface, and which lessens dimensional error so that the scissor segments neatly slide on each other.

To achieve the foregoing object, in the present invention, A structure for rotation center of scissors comprising a projection provided on a first surface of a first scissor segment and a concave portion provided on a second surface, opposite to said first surface of said first scissor segment, of a second scissor segment, both said scissor segments being connectable mutually so as to be opened and closed by engagement of said projection and said concave portion.

The specific nature of the invention, as well as other objects, uses and advantages thereof, will clearly appear form the description and from the accompanying drawing.

BRIEF DESCRIPTION OF THE DRAWINGS

FIGS. 1 through 5 show a first embodiment of scissors embodying the present invention in which:

FIG. 1 is a perspective view showing assembled scissors,

FIG. 2 is a perspective view of one scissor segment,

FIG. 3 is a perspective view of the other scissor segment,

FIG. 4 is an enlarged plan view, partly in section, showing a rotation center, FIG. 5 is a sectional view taken along the A—A line in FIG. 4.

FIGS. 6 through 9 show a second embodiment in which;

FIG. 6 is a perspective view showing one scissor segment,

FIG. 7 is a perspective view showing the other scissor segment,

FIG. 8 is an enlarged plan view, partly in section, showing a rotation center, FIG. 9 is a sectional view taken along the B—B line in FIG. 8.

FIGS. 10 through 13 show a third embodiment in which;

FIG. 10 is a perspective view showing one scissor segment,

FIG. 11 is a perspective view showing the other scissor segment,

FIG. 12 is an enlarged plan view, partly in section, showing a rotation center, FIG. 13 is a sectional view taken along the C—C line in FIG. 12.

FIGS. 14 through 17 show a fourth embodiment in which;

FIG. 14 is a perspective view showing on scissor segment,

FIG. 15 is a perspective view showing the other scissor segment,

FIG. 16 is an enlarged plan view, partly in section, showing a rotation center, FIG. 17 is a sectional view taken along the D—D line in FIG. 16.

FIGS. 18 through 21 show a fifth embodiment in which;

FIG. 18 is a perspective view showing one scissor segment,

FIG. 19 is a perspective view showing the other scissor segment,

FIG. 20 is an enlarged plan view, partly in section, showing a rotation center, FIG. 21 is a sectional view taken along the E—E line in FIG. 20.

DETAILED DESCRIPTION OF THE PREFERRED EMBODIMENT

Figure 1:
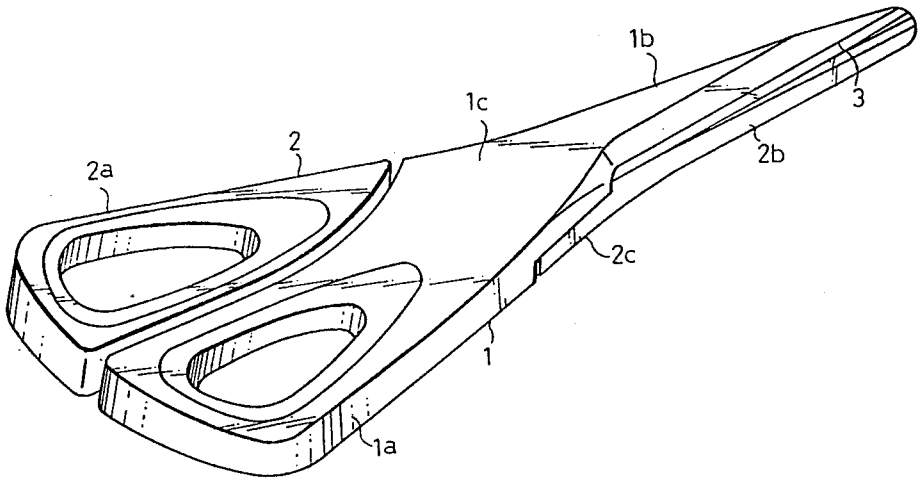

The first embodiment of the scissors embodying the present invention will now be described in detail with reference to FIGS. 1 through 5. A pair of scissor segments 1, 2, shown in FIG. 1, are formed out of synthetic resin material. Furthermore, grips 1*a*, 2*a* for inserting fingers and a thumb are formed on one ends of the scissor segments 1, 2, and blade mounting portions 1*b*, 2*b* are integrally formed on the other ends of the scissor segments 1, 2. And, blades 3, 4 are adhered to be fixed to the inside surfaces of the blade mounting portions 1*b*, 2*b*.

Figure 2:
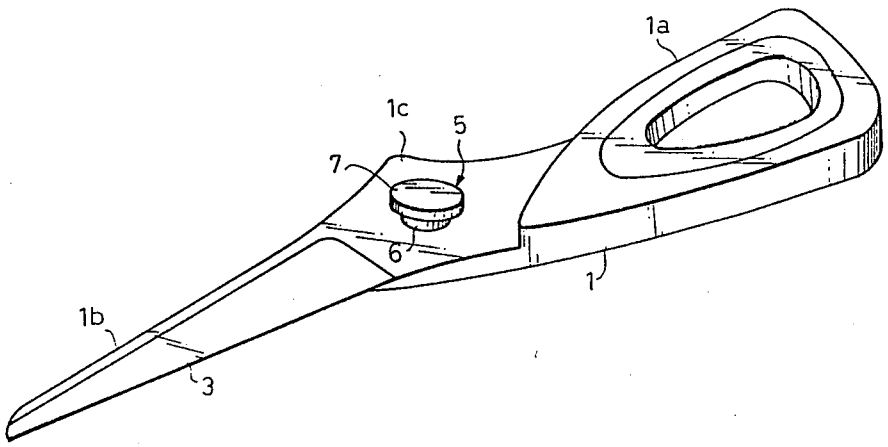
Figure 4:
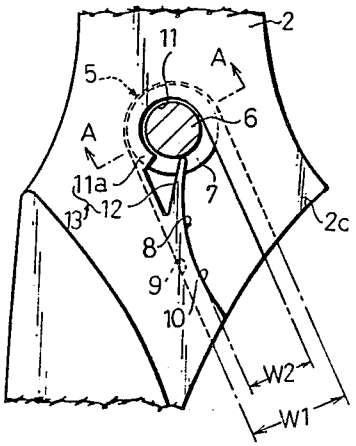
Figure 3:
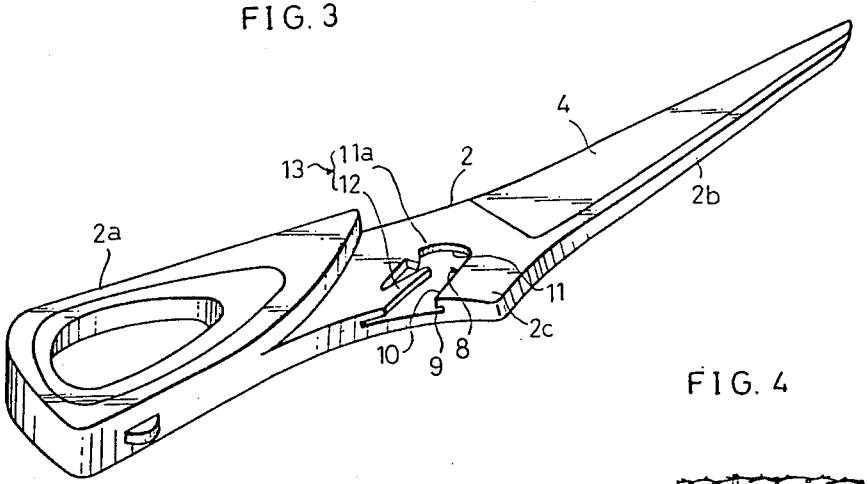

As shown in FIG. 2, a projection 5 is integrally formed to project from the inside surface of a rotation center 1*c* of the one scissor segment 1. This projection 5 has a base end side stem portion 6 and a tip side engage portion 7 having a larger diameter than that of the stem portion 6. As shown in FIG. 3 and 4, a concave portion 8 is formed on the inside surface of a rotation center 2*c* of the other scissor segment 2. A first opening 9, opening at the inside edge of the scissor segment 2, extending to the center of the scissor segment 2 and having a width W1 little broader than the diameter of the engage portion 7, is formed in the concave portion 8. And a second opening 10 adjacent to the first opening 9 and having a width W2 narrower than that of the first opening 9 is formed in the concave portion 8. Furthermore, a circular stem supporting portion 11 is formed at the inner end of the second opening 10 and an elastic engage piece 12 is intergrally formed to project from one of the inner edges of the second opening 10.

Moreover, a stopper 13 preventing the engage portion 7 from being released from the first opening 9 is constituted of the elastic engaging piece 12 and a circumferential edge 11*a* of the stem supporting portion 11. And, as shown in FIG. 5, the outer surfaces of the rotation centers 1*c*, 2*c* of the scissor segments 1, 2 are formed plane.

In assembling both the scissor segments 1, 2, they have the inner surfaces faced to each other. Next, the engage portion 7 and the stem portion 6 of the one scissor segment 1 are correspondingly placed on the opening end of the first and second openings 9, 10 and slided along the bottom surface of the first opening 9 toward the stem supporting portion 11. Then the elastic engaging piece 12 is engaged with the stem portion 6, and bent toward the inner edge side of the second opening 10 against its own elasticity. When the stem portion 6 is received by the stem supporting portion 11, the elastic engaging piece 12 is returned to its original position as shown in FIG. 4. Accordingly, the assemblage of both the scissor segments 1, 2 is finished quite simply in short time.

Figure 5:
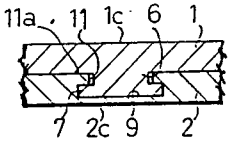

In the scissors assembled as aforesaid, as shown in FIGS. 4 and 5, the engaging porion 7 engages with circumferential edge 11*a* of the stem supporting portion 11 and the elastic engaging piece 12, so that both the scissor segments 1, 2 are certainly prevented from separating in the axial direction of the stem portion 6. Moreover, movement of the stem portion 6 to the opening end side of the first and second openings 9, 10 is certainly prevented by the engagement of the elastic engaging piece 12 and the stem portion 6.

Furthermore, in use of the scissors, when both the scissor segments 1, 2 are opened and closed about the stem portion 6 as center, the stem portion 6 has its periphery guided by the stem supporting portion 11 and the tip of the elastic engaging piece 12 so as to rotate smoothly. Moreover, in the present embodiment, no center shaft is exposed from the outside surfaces of the rotation centers 1*c*, 2*c* of the scissor segments so that scissors of excellent design can be manufactured. Moreover, as both the scissor segments 1, 2 can be connected by the projection 5 and the concave portion 8 intergrally formed on each of the scissor segments 1, 2, dimensional error is lessened so that the blades 3, 4 of both the scissor segments 1, 2 can be neatly slided on each other.

Next, some other embodiments of the present invention will be orderly described hereinafter focusing on differences over the first embodiment.

Figure 8:
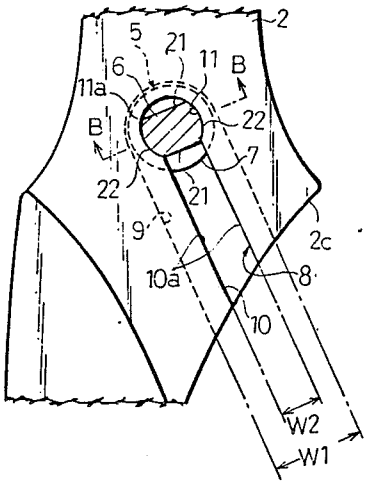
Figure 6:
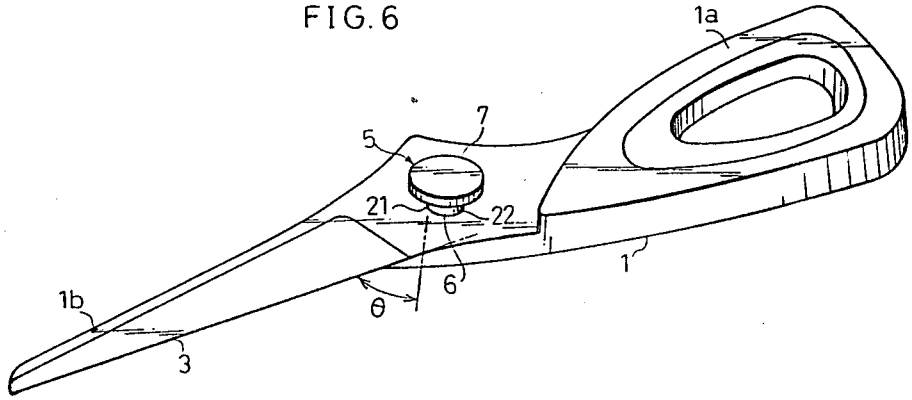
Figure 7:
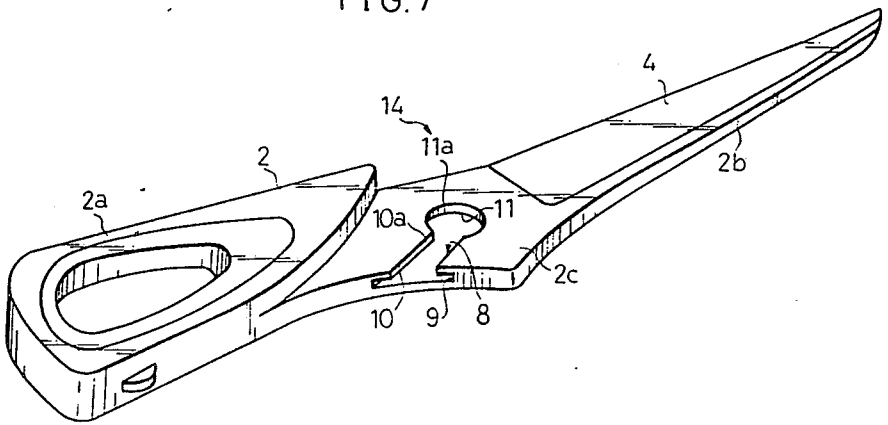

In the second embodiment shown in FIGS. 6 through 9, as shown in FIGS. 6 and 8, a pair of guide surfaces 21, crossing a cutting edge of the blade 3 with a determined angle $\theta$ are formed on the circumferential surface of the stem portion 6 of the projection 5 in the one scissor segment 1. The angle $\theta$ is predetermined to be larger than a predetermined open-close angle range for opening and closing both the scissor segments 1, 2 during use of the scissors. Furthermore, a width W2 of the second opening 10 of the concave portion 8 in the other scissor segment 2 is predetermined a little broader than that of the interval between the pair of guide surfaces 21, and, is narrower than a maximum diameter of the stem portion 6.

Figure 9:
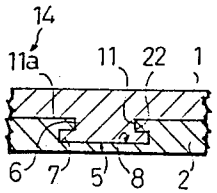

When the engage portion 7 is slided along the bottom surface of the first opening 9, in assembling the scissors of the present embodiment, the stem portion 6 is easily moved toward the stem supporting portion 11 by placing the guide surfaces 21 between opposite inner edges 10*a* of the second opening 10. Then after placing the stem portion 6 in the stem supporting portion 11 both the scissor segments 1, 2 are rotated in closing direction to the predetermined open-close angle range, as shown in FIGS. 8 and 9. Consequently, movement of the stem portion 6 to the opening end is regulated by the engagement of the peripheral surface of the stem portion 6 and the inner edges 10*a* of the second opening 10. Furthermore, release of both the scissor segments 1, 2 in the axial direction of the stem portion 6 is prevented by the engagement of the engage portion 7 and a circumferential edge 11*a* of the stem supporting portion 11 constituting a restricting portion 14 together with the inner edge 10*a*.

Therefore, also in this second embodiment, in the same manner as the first embodiment, the center shaft is not exposed from the outside surfaces of the rotation centers 1*c*, 2*c* of each scissor segments 1, 2 so that scissors of excellent design can be manufactured. Furthermore, as both the scissor segments 1, 2 can be connected by the projection 5 and the concave portion 8 integrally formed on each of the scissor segments 1, 2, dimensional error is lessened so that the blades 3, 4 of both the scissor segments 1, 2 are neatly slided on each other. Moreover, design of the second opening 10 can be simplified so that manufacturing costs can be decreased more than that of the first embodiment.

Additionally, in this embodiment, by opening both the scissor segments 1, 2 beyond the predetermined open-close angle range, placing each guide surface 21 of the stem portion 6 on an elongated line of the inner edge 10*a* of the second opening 10, and sliding the one scissor segment 1 along the second opening 10, both the scissor segments 1, 2 can be easily separated from each other so that the cleaning and the grinding of the scissors can be easily done.

Figure 12:
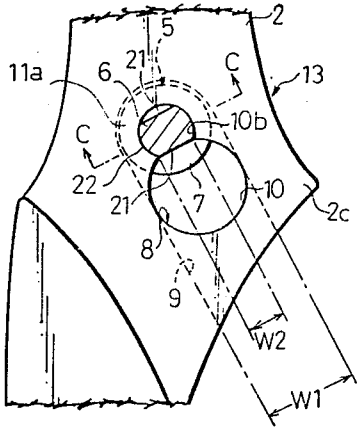
Figure 13:
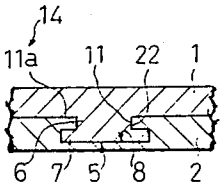
Figure 10:
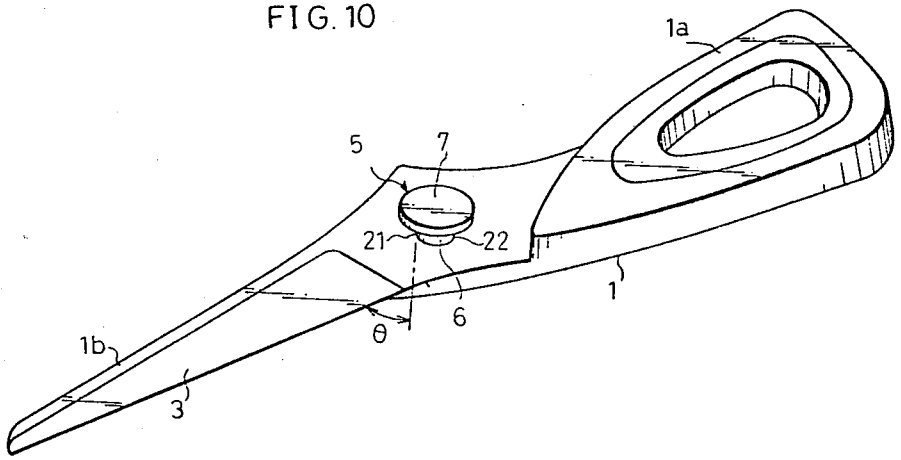
Figure 11:
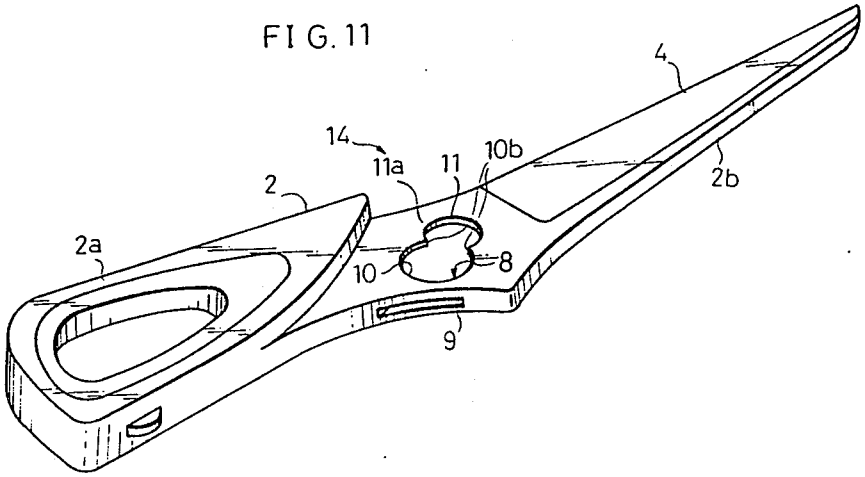
Figure 16:
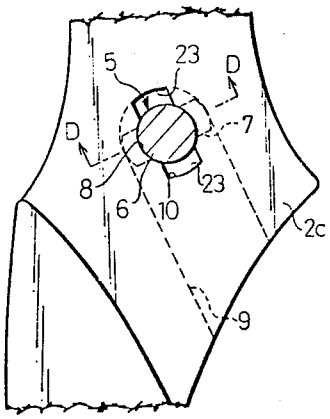
Figure 17:
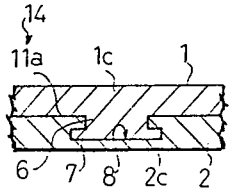

In the third embodiment shown in FIGS. 10 through 13, the second opening 10 is formed to be circular, in connection with the stem supporting portion 11. Furthermore, as shown in FIG. 12, the width W2 of the second opening 10 in the opening end 10*b* is predetermined a little broader than the interval between the guide surfaces 21 of the projection 5 in the stem portion 6 while the diameter of the second opening 10 is predetermined a little broader than the diameter of the engage portion 7.

Therefore, in the present third embodiment, both the scissor segments 1, 2 can be easily assembled by sliding the projection 5 toward the stem supporting portion 11 with each guide surface 21 of the stem portion 6 corresponded to the opening end 10*b* of the stem supporting portion 11, after the engage portion 7 of the one scissor segment 1 is entered into the first opening 9 through the second opening 10. Furthermore, the engagement of the circumferential edge 11*a* of the stem supporting portion 11, which constitutes the restricting portion 14, with the engage portion 7, and the engagement of a peripheral surface 22 of the stem portion 6 with an opening end 10*b* of the second opening 10 prevent both the scissor segments 1, 2 from separating each other within the predetermined open-close angle range. Moreover, placed beyond the predetermined open-close angle range, with both the guide surfaces 21 facing the opening end 10*b* of the second opening 10, both of the scissor segments 1, 2 can be easily separated from each other in the same manner as the second embodiment.

And, also in this third embodiment, the center shaft is not exposed so that scissors of excellent design can be manufactured, and dimensional error is lessened so that the blades 3, 4 of both the scissor segments 1, 2 are neatly slided on each other. Furthermore, as the second opening 10 is formed to be a round hole, labour of sliding operation of the engage portion 7 during the assemblage and disassemblage of the scissors can be reduced.

Figure 14:
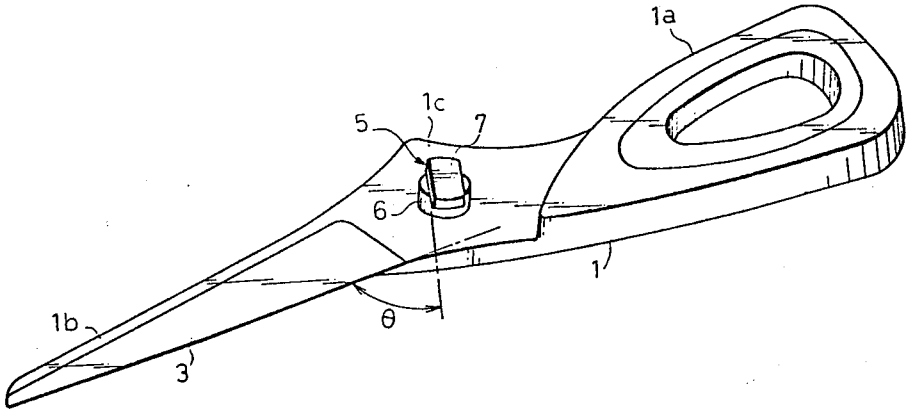
Figure 15:
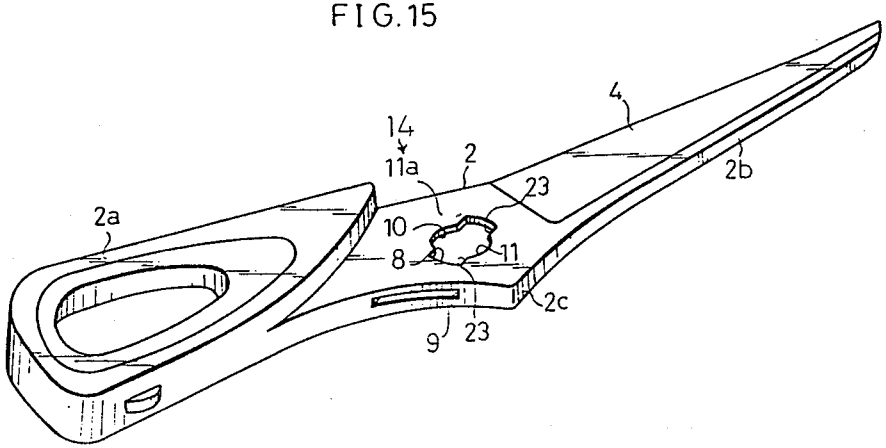

In the fourth embodiment shown in FIGS. 14 through 17, a notch 23 is formed to extend in such a direction as cross the cutting edge of the blade 4 of the scissor segment 2 at a definite angle. A plate-like engage portion 7 is integrally formed on the tip of the projection 5 as shown in FIG. 14, so as to extend at a definite angle $\theta$ with the cutting edge of the blade 3 in the scissor segment 1 and to be able to enter into the notch 23.

In assembling the scissors, the side surfaces of the rotation centers 1*c*, 2*c* of both the scissor segments 1, 2 are faced to each other, and the plate-like engage portion 7 of the projection 5 is entered into the first opening 9 through the notch 23 and the stem supporting portion 11. Then, both the scissor segments 1, 2 are easily assembled by rotating both the scissor segments 1, 2 around the stem portion 6 of the projection 5 in a closing direction. Consequently, the circumferential edge 11*a* of the stem supporting portion 11, which forms the restricting portion 14, engages with the engage portion 7, so that separation of both the scissor segments 1, 2 is prevented within the predetermined open-close angle range. Furthermore, both the scissor segments 1, 2, which has been assembled, can be easily separated from each other by opening both the scissor segments 1, 2 beyond the predetermined open-close angle range and placing the plate-like engage portion 7 opposite to the notch 23.

Therefore, this fourth embodiment, has not only the same effects as the second and third embodiments but also an effect to require no sliding operation of the projection 5, during the assemblage of the scissors.

Figure 18:
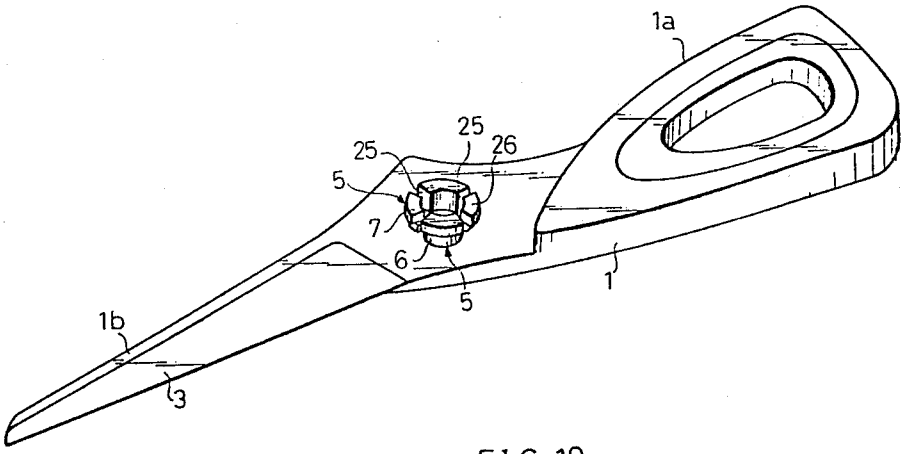
Figure 19:
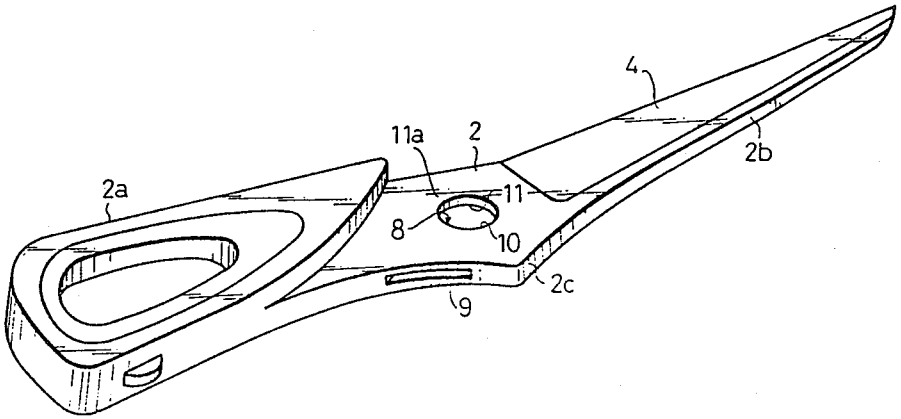

In the fifth embodiment shown in FIGS. 18 through 21, a plurality of slits 25 running in direction of the axis of the stem portion 6 are formed on the projection 5 in the one scissor segment 1 as shown in FIG. 18. The stem portion 6 and the engage portion 7 are divided into parts by each of the slits 25 so that each divided portion 26 can be bent toward the center of the shaft against their elasticity.

Figure 20:
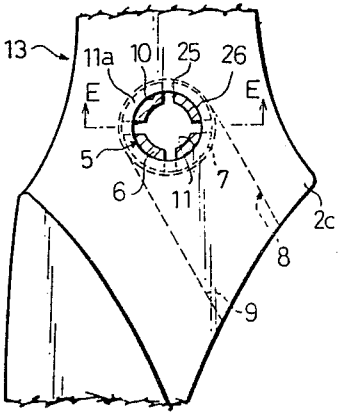
Figure 21:
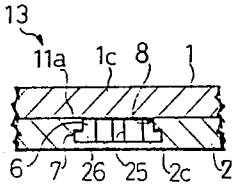

In assembling, the inner surfaces of the rotation centers 1*c*, 2*c* of both the scissor segments 1, 2 are faced each other, and divided portions 26 are pushed into the round hole of the stem supporting portion 11 of the other scissor segment 2, then, the divided portions 26 are bent toward the center of the stem portion 6, and the engage portion 7 is entered into the first opening 9 through the stem supporting portion 11. Further, the divided portions 26 return to their original positions by their elasticity so as to be placed and latched in the first opening 9. Furthermore, as shown in FIGS. 20 and 21, separation of both the scissor segments 1, 2 after the assemblage is prevented, at any open-close angle, by the engagement of the circumferential edge 11*a* of the stem supporting portion 11 forming the restricting portion 13 with the engage portion 7.

Consequently, also in this embodiment, the effects like the aforementioned embodiments can be performed, while the assemblage can be more simplified because of no need of sliding operation of the projection 5 and rotating operation of both the scissor segments 1, 2.

Moreover, the present invention is not limited to the above embodiments, for example, the elastic engaging piece 12 in the first embodiment can be formed as a separate member having elasticity, and the present invention can be embodied in bow scissors wherein rotation centers are provided on the ends of the scissors segments.

As many apparently widely different embodiments of this invention may be made without departing from the spirit an scope thereof, it is to be understood that the invention is not limited to the specific embodiments thereof except as defined in the appended claims.

What is claimed is:

1. A structure for rotation center of scissors comprising;

a projection provided on a first surface of a first scissor segment, said projection including a stem portion and an engage portion provided on a tip of said stem portion and having a larger diameter than a diameter of said stem portion, a concave portion provided on a second surface, opposite to said first surface of said first scissor segment, of a second scissor segment, said concave portion having a stopper preventing said projection from being released from said concave portion at any open-close angle of both said scissor segments, both said scissor segments being connectable mutually so as to be opened and closed by engagement of said projection and said concave portion, said concave portion has a first opening, having a first width at least larger than the diameter of said engage portion and accommodating said engage portion, and a second opening connected with said first opening, having a second width smaller than the diameter of said engage portion and larger than the diameter of said stem portion, and accommodating said stem portion.

2. A structure for rotation center of scissors comprising;

a projection provided on a first surface of a first scissor segment, said projection including a stem portion and an engage portion provided on a tip of said stem portion and having a larger diameter than a diameter of said stem portion, a concave portion provided on a second surface, opposite to said first surface of said first scissor segment, of a second scissor segment, said concave portion having a stopper preventing said projection from being released from said concave portion at any open-close angle of both said scissor segments, said stopper is provided on said second opening and includes an elastic engaging portion whose tip is in contact with said stem portion, both said scissor segments being connectable mutually so as to be opened and closed by engagement of said projection and said concave portion, said concave portion has a first opening, having a first width at least larger than the diameter of said engage portion and accommodating said engage portion, and a second opening connected with said first opening, having a second width smaller than the diameter of said engage portion and larger than the diameter of said stem portion, and accommodating said stem portion.

3. A structure for rotation center of scissors comprising;

a projection provided on a first surface of a first scissor segment, said projection including a stem portion and an engage portion provided on a tip of said stem portion and having a larger diameter than a diameter of said stem portion, said engage portion has slits and divided portions divided by said slits, said stopper including a circumferential edge provided on said second opening and engaging said divided portions of said engage portion, a concave portion provided on a second surface, opposite to said first surface of said first scissor segment, of a second scissor segment, said concave portion having a stopper preventing said projection from being released from said concave portion at any open-close angle of both said scissor segments, both said scissor segments being connectable mutually so as to be opened and closed by engagement of said projection and said concave portion, said concave portion has a first opening, having a first width at least larger than the diameter of said engage portion and accommodating said engage portion, and a second opening connected with said first opening, having a second width smaller than the diameter of said engage portion and larger than the diameter of said stem portion, and accommodating said stem portion.

4. A structure for rotation center of scissors comprising;

a projection provided on a first surface of a first scissor segment, said projection including a stem portion and an engage portion provided on a tip of said stem portion and having a larger diameter than a diameter of said stem portion, a concave portion provided on a second surface, opposite to said first surface of said first scissor segment, of a second scissor segment, both said scissor segments being connectable mutually so as to be opened and closed by engagement of said projection and said concave portion, said concave portion has a first opening, having a first width at least larger than the diameter of said engage portion and accommodating said engage portion, and a second opening connected with said first opening, having a second width smaller than the diameter of said engage portion and larger than the diameter of said stem portion, and accommodating said stem portion, and both of said first and second openings open at an inner edge of said second scissor segment and extend toward a center of said second scissor segment.

5. A structure for rotation center of scissors comprising;

a projection provided on a first surface of a first scissor segment, said projection including a stem portion and an engage portion provided on a tip of said stem portion and having a larger diameter than a diameter of said stem portion, a concave portion provided on a second surface, opposite to said first surface of said first scissor segment, of a second scissor segment, both said scissor segments being connectable mutually so as to be opened and closed by engagement of said projection and said concave portion, said concave portion has a first opening, having a first width at least larger than the diameter of said engage portion and accommodating said engage portion, and a second opening connected with said first opening, having a second width smaller than the diameter of said engage portion and larger than the diameter of said stem portion, and accommodating said stem portion, and said concave portion has a restricting portion preventing said projection from being released from said concave portion within maximum open-close angle range of both said scissor segments during ordinary use, and allowing said projection to be released from said concave portion beyond the maximum open-close angle range.

6. A structure for rotation center of scissors comprising;

a projection provided on a first surface of a first scissor segment, said projection including a stem portion, said stem portion has two guide surfaces opposite to each other in a direction of radius of said stem portion, and an engage portion provided on a tip of said stem portion and having a larger diameter than a diameter of said stem portion, a concave portion provided on a second surface, opposite to said first surface of said first scissor segment, of a second scissor segment, both said scissor segments being connectable mutually so as to be opened and closed by engagement of said projection and said concave portion, said concave portion has a first opening, having a first width at least larger than the diameter of said engage portion and accommodating said engage portion, and a second opening connected with said first opening, having a second width smaller than the diameter of said engage portion and larger than the diameter of said stem portion, and accommodating said stem portion, said both openings extend from an inner edge of said second scissor segment to a center of said second scissor segment, said concave portion has a restricting portion preventing said projection from being released from said concave portion within maximum open-close angle range of both said scissor segments during ordinary use, and allowing said projection to be released from said concave portion beyond the maximum open-close angle range, and said restricting portion is provided on said second opening and comprises a portion of a third width smaller than the diameter of said stem portion.

7. A structure for rotation center of scissors comprising;

a projection provided on a first surface of a first scissor segment, said projection including a stem portion and an engage portion provided on a tip of said stem portion and having a larger diameter than a diameter of said stem portion, said engage portion is rectangular shaped, a concave portion provided on a second surface, opposite to said first surface of said first scissor segment, of a second scissor segment, both said scissor segments being connectable mutually so as to be opened and closed by engagement of said projection and said concave portion, said concave portion has a first opening, having a first width at least larger than the diameter of said engage portion and accommodating said engage portion, and a second opening connected with said first opening, having a second width smaller than the diameter of said engage portion and larger than the diameter of said stem portion, and accommodating said stem portion, and said concave portion has a restricting portion preventing said projection from being released from said concave portion within maximum open-close angle range of both said scissor segments during ordinary use, and allowing said projection to be released from said concave portion beyond the maximum open-close angle range, said restricting portion is provided on said second opening, and comprises a notch allowing said engage portion to be released form said second opening only in case that both said scissor segments are opened at a predetermined angle.

* * * * *